US006070935A

United States Patent [19]

Heimann et al.

[11] Patent Number: 6,070,935

[45] Date of Patent: Jun. 6, 2000

[54] RECLINER WITH MOVABLE HEAD OR FOOT PART

[75] Inventors: Dieter Heimann, Dortmund; Martin Kristen, Gelsenkirchen; Martin Braun, Wetter, all of Germany

[73] Assignee: Stanzwerk Wetter Sichelschmidt GmbH & Co. KG, Wetter, Germany

[21] Appl. No.: 09/044,647

[22] Filed: Mar. 19, 1998

[30] Foreign Application Priority Data

Apr. 29, 1997 [DE] Germany ..... 297 07 738 U
Sep. 23, 1997 [DE] Germany ..... 197 41 814

[51] Int. Cl.[7] ..... A47C 1/02

[52] U.S. Cl. ..... 297/68; 297/354.13

[58] Field of Search ..... 297/68, 119, 354.13, 297/463.1, 423.19; 5/12.1, 41, 47, 18.1

[56] References Cited

U.S. PATENT DOCUMENTS 2,875,814 3/1959 Schliephacke ..... 297/84
3,099,487 7/1963 Knabusch et al. ..... 297/423.19
5,678,264 10/1997 Walker ..... 297/354.13 X

*Primary Examiner*—Milton Nelson, Jr.
*Attorney, Agent, or Firm*—Herbert Dubno; Andrew Wilford

[57] ABSTRACT

A piece of furniture has a generally stationary main part, an actuator in the main part, and a movable part that is pivotal on the main part generally about an axis. An actuating assembly for the movable part has an elongated one-piece operating bar formed of a single piece of tubing having a central portion extending along the axis and a pair of U-shaped end portions each having an inner arm forming a continuation of a respective outer end of the central portion and an outer arm extending across the axis, projecting radially therefrom, and provided with mounting formations. The portions and arms all are generally coplanar. Pivot pins fixed on the main part engage through the outer arms at the axis for pivoting of the operating bar on the main frame about the axis. Respective fittings secured to the mounting formations of the outer arms are connected to the movable part and a crank arm fixed on the central portion and extending radially therefrom is operatively connected to the actuator in the main part.

13 Claims, 4 Drawing Sheets

RECLINER WITH MOVABLE HEAD OR FOOT PART

FIELD OF THE INVENTION

The present invention relates to reclining furniture. More particularly this invention concerns an actuating assembly for a piece of reclining furniture having a raisable and lowerable head or foot part, e.g. a convertible chair or sofa.

BACKGROUND OF THE INVENTION

A standard recliner has a generally fixed and normally horizontal main body on which a head and/or foot part is movable between a horizontal position level with the main body and a raised and/or lowered position extending at an angle thereto. The movable part is typically hinged and/or slidable on the frame of the piece of furniture and is typically raised and/or lowered by an operating bar extending along a pivot axis fixed in the frame and having arms engaging the movable part and at least one crank arm engaged by an actuator normally housed in the main part. Thus the actuator can pivot the operating bar about its axis to raise and/or lower the movable part, to which end the actuator is typically a motor having a threaded output spindle carrying a nut fixed to the crank arm of the operating element.

Such a structure is relatively effective but difficult to manufacture and, due to its multipart welded construction, almost impossible to apply a neat coat of paint to. What is more the operating bar must normally be custom built for each application, further increasing its unit cost.

OBJECTS OF THE INVENTION

It is therefore an object of the present invention to provide an improved actuating assembly for a recliner.

Another object is the provision of such an improved actuating assembly for a recliner which overcomes the above-given disadvantages, that is which is of simple construction so that it can be manufactured cheaply and painted easily.

SUMMARY OF THE INVENTION

A piece of furniture has a generally stationary main part, an actuator in the main part, and a movable part that is pivotal on the main part generally about an axis. An actuating assembly for the movable part has according to the invention an elongated one-piece operating bar formed of a single piece of tubing having a central portion extending along the axis and a pair of U-shaped end portions each having an inner arm forming a continuation of a respective outer end of the central portion and an outer arm extending across the axis, projecting radially therefrom, and provided with mounting formations. The portions and arms all are generally coplanar. Pivot pins fixed on the main part engage through the outer arms at the axis for pivoting of the operating bar on the main frame about the axis. Respective fittings secured to the mounting formations of the outer arms are connected to the movable part and a crank arm fixed on the central portion and extending radially therefrom is operatively connected to the actuator in the main part.

The operating element can therefore be made cheaply of a piece of bent tubing but will have all the strength of a much heavier solid bar. According to the invention outer portions of the outer arms are flattened and provided with the formations. Thus it is of very simple construction so it not only can be made inexpensively, but it is easy to paint.

The frame is formed at the axis with a pair of holes in which the pivot pins are set. In addition a respective bushing or spacer washer is mounted on each pin between the respective outer arm and the frame. This keeps the arm from scraping the frame, which normally has a bracket for each pivot pin.

The central and end portion are of circular section. Furthermore each pivot pin has a head bearing on the respective outer arm and a shank extending through the respective outer arm and through the frame and is provided with a spacer washer between the respective outer arm and the frame. The frame includes a bracket in which the shank is anchored. For symmetrical application of force for raising and/or lowering the movable part, which can be a foot or head rest, the crank arm is equispaced between the end portions.

The fittings in accordance with the invention have formations complementary to the formations of the respective outer arms. Some of the formations are studs and the formations they fit with are holes. More particularly the formations of the outer arms are a row of holes and the formations of each fitting include at least one stud engageable in one of the respective outer-arm holes and another hole alignable with another of the respective outer-arm holes. The assembly further has according to the invention bolts engaged through other holes and securing the outer arms to the fittings. These bolts are provided with respective nuts.

The fitting can be provided with a roller engaging the movable part. Alternately it can have a bracket fixed to the movable part.

BRIEF DESCRIPTION OF THE DRAWING

The above and other objects, features, and advantages will become more readily apparent from the following description, reference being made to the accompanying drawing in which.

SPECIFIC DESCRIPTION

Figure 8:
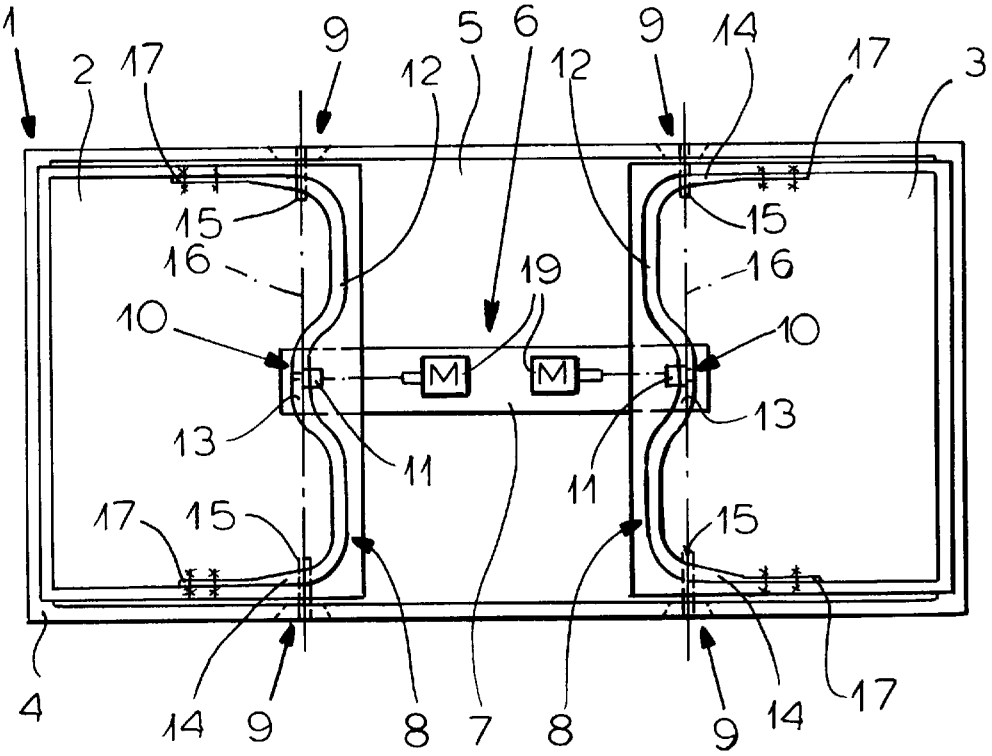
FIG. 8 is a small-scale top view of the piece of furniture of FIG. 3.
Figure 3:
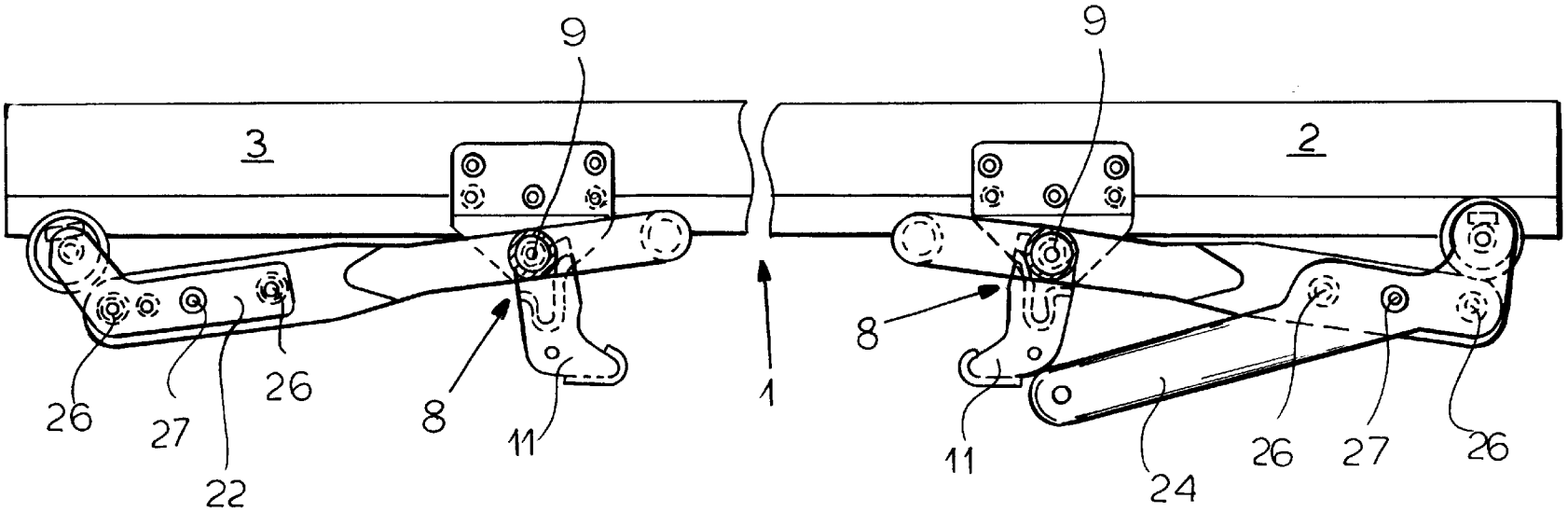
FIG. 3 is a side view of most of the actuating assembly for a piece of furniture according to the invention.

As seen in FIGS. 3 and 8 a piece 1 of furniture has a foot part 2 and a head part 3 both movable relative to a fixed main part 5 and all carried on a furniture frame 4. A drive 6 having a housing 7 is mounted amidships in the main part 5 and has a pair of oppositely effective actuators 19, normally motors with threaded spindles carrying nuts. When the foot part 2, head part 3, and main part 5 are all horizontal and coplanar as illustrated, the piece 1 functions as a bed. The foot part 2 can be lowered and the head part 3 raised to form it into a chair.

Figure 1:
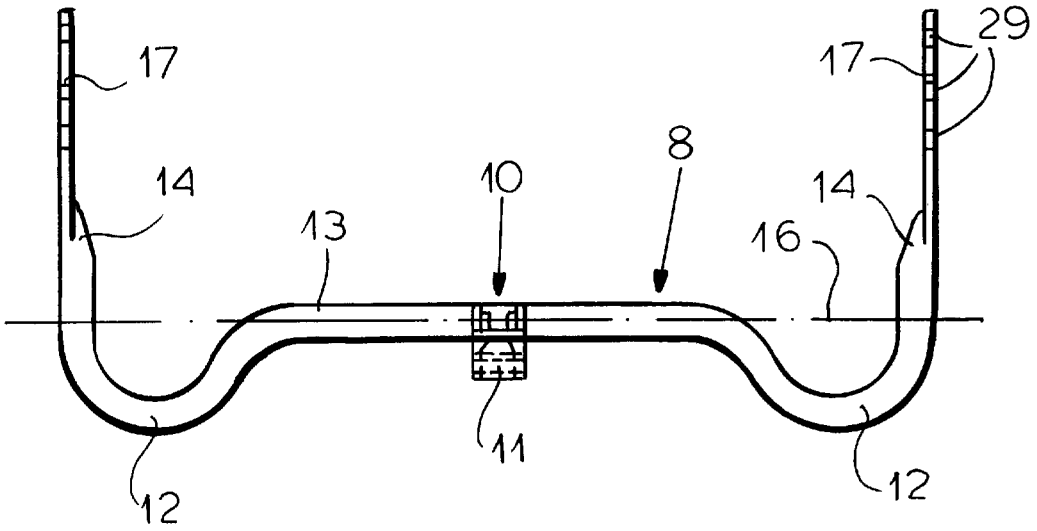
FIG. 1 is a small-scale top view of the operating bar according to the invention.

According to the instant invention a pair of identical operating bars 8 each formed of a single piece of painted steel tubing are provided to raise and/or lower the movable parts 2 and 3. As shown in FIG. 1 each such operating bar 8 has a straight central portion 13 extending along a pivot axis 16 and having outer ends unitarily joined to inner arms of identical U-shaped outer portions 12 having outer arms 14 that extend across the axis 16. Pivots 9 mount the bar 8 for pivoting about the axis 16.

Figure 2:
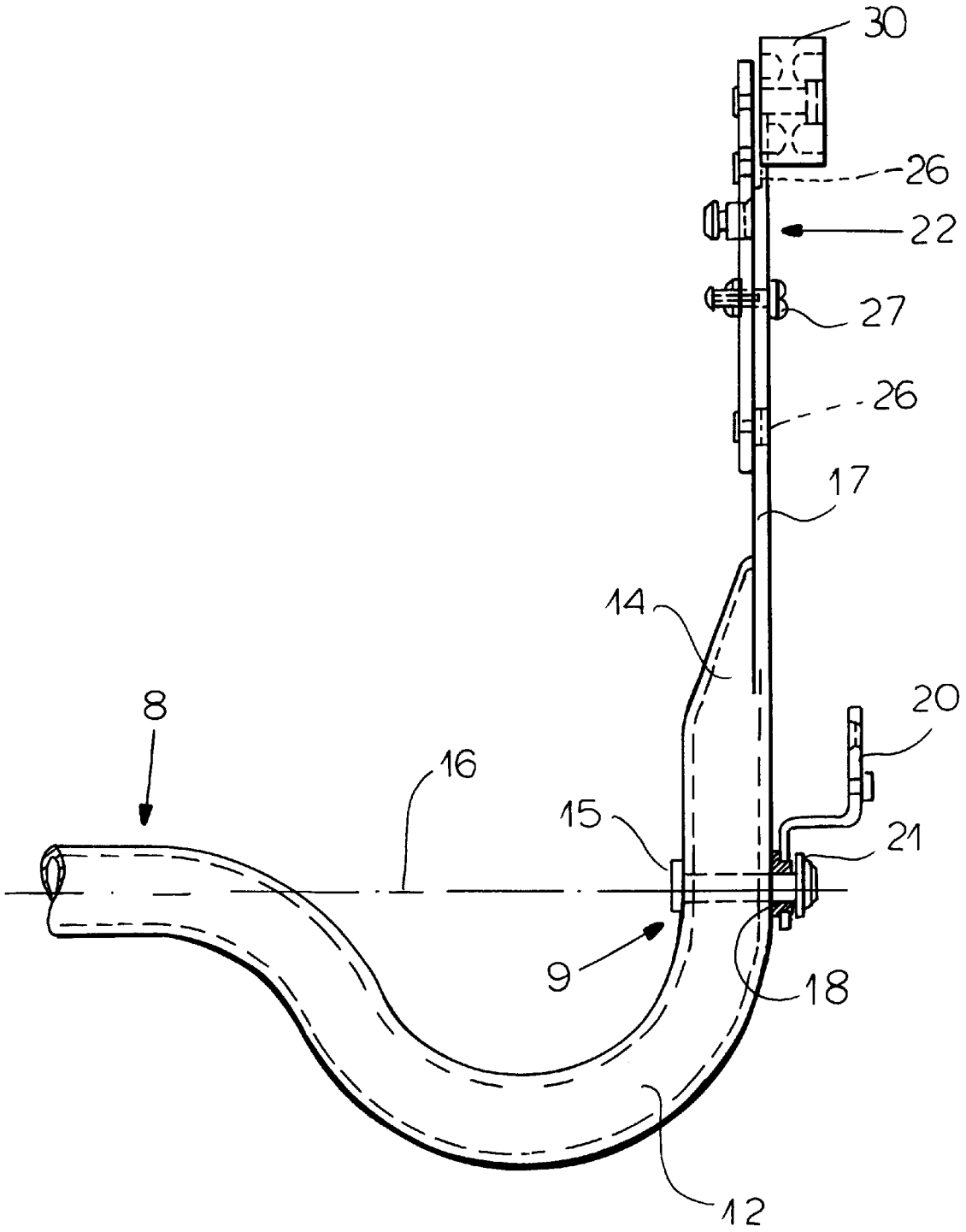
FIG. 2 is a larger-scale view of a detail of FIG. 1.

More specifically as shown in FIG. 2 each such pivot 9 includes a pin or bolt 15 traversing the respective arm 14 and carrying a bushing or washer 18 to prevent the arm 14 from rubbing. The bolts 15 are secured in brackets 20 that are fixed on the frame 4 by stop rings 21. Thus each bar 8 is solidly mounted on the frame 4 for free pivoting about the axis 16. The fact that the pin or bolt 15 passes through both walls of the tubular arm 14 keeps it centered on the axis 16 so that a simple bracket 20 can be used.

Centrally the bars 8 are each provided with a radially extending crank arm 11 that engages through a hole 10 in the housing 7 for operation by the respective actuator 19. Thus as the actuators 19 push or pull the radial outer ends of the respective crank arms, the respective bar 8 will pivot about its axis 16.

Figure 5:
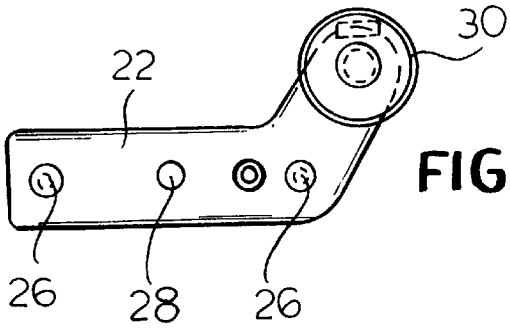

Each outer arm 14 has outward of the axis 16 an outer portion 17 that is flattened, that is both walls of the tube have been pushed together to form a flat double-thickness end portion. Each such outer portion 17 is formed with straight row of three holes 29. As shown in FIG. 2 these formations 29 allow a fitting 22 to be secured solidly to the end portion 17. To this end the fitting 22 has a pair of studs 26 flanking a hole 28 so that the studs 26 can be fitted to the end holes 29 with the hole 28 aligned with the center hole 29, and then a nut and bolt 27 can be inserted through the aligned center hole 29 and hole 28 to secure the fitting 22 to the portion 17. As also shown in FIG. 5 this fitting 22 has an outer end provided with a roller 30 for securing to the part 2 or 3.

Figure 4:
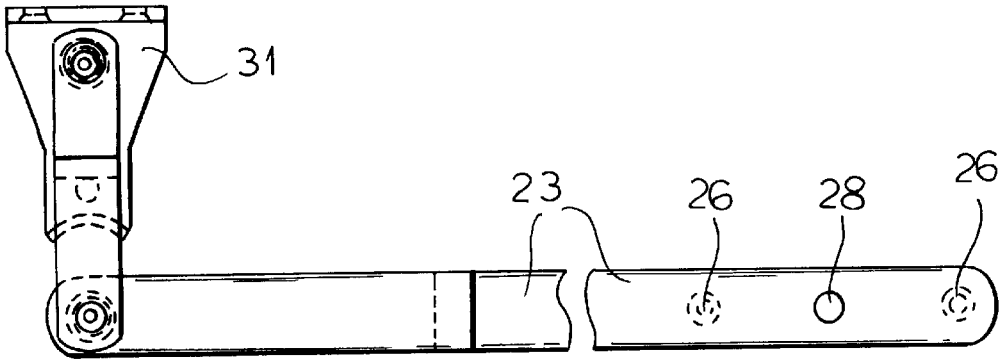
FIGS. 4, 5, 6, and 7 are side view of end fittings for the bar of FIG. 1.
Figure 6:
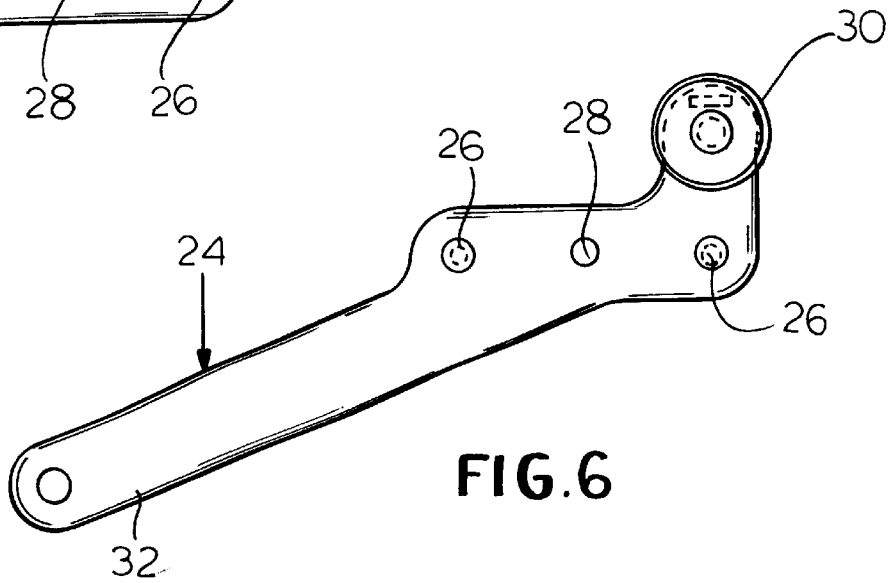
Figure 7:
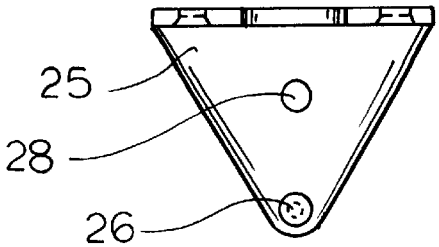

FIG. 4 shows a fitting 23 having studs 26 and a hole 28 like the fitting 22, but provided with an articulated end bracket 31. In FIG. 6 the fitting 24 has a roller 30 and an oppositely extending arm 32. The fitting 25 of FIG. 7 is a simple bracket with only one stud 26. Thus it is possible to use the operating bar 8 with many different types of end fittings, making it suitable for different applications in different types of furniture.

We claim:

1. An actuating assembly for a piece of furniture having a generally stationary main part, an actuator in the main part, and a movable part that is pivotal on the main part generally about an axis, the actuating assembly comprising:

an elongated one-piece operating bar formed of a single piece of tubing having a central portion extending along the axis and a pair of U-shaped end portions each having an inner arm forming a continuation of a respective outer end of the central portion and an outer arm extending across the axis, projecting radially therefrom, and provided with mounting formations, the portions and arms all being generally coplanar;

pivot pins fixable on the main part and engaging through the outer arms at the axis for pivoting of the operating bar on the main part about the axis;

respective fittings secured to the mounting formations of the outer arms and connectable to the movable part; and a crank arm fixed on the central portion, extending radially therefrom, and operatively connectable to the actuator in the main part.

2. The furniture-actuating assembly defined in claim 1 wherein outer portions of the outer arms are flattened and provided with the formations.

3. The furniture-actuating assembly defined in claim 1 wherein the fitting is provided with a roller engaging the movable part.

4. The furniture-actuating assembly defined in claim 1 wherein the fitting has a bracket fixable to the movable part.

5. The furniture-actuating assembly defined in claim 1 wherein the central and end portions are of circular section.

6. The furniture-actuating assembly defined in claim 1 wherein each pivot pin has a head bearing on the respective outer arm and a shank extending through the respective outer arm and through the frame and is provided with a spacer washer between the respective outer arm and the frame, the frame including a bracket in which the shank is anchored.

7. The furniture-actuating assembly defined in claim 1 wherein the crank arm is equispaced between the end portions.

8. The furniture-actuating assembly defined in claim 1 wherein the fittings have formations complementary to the formations of the respective outer arms.

9. The furniture-actuating assembly defined in claim 8 wherein some of the formations are studs and the formations they fit with are holes.

10. The furniture-actuating assembly defined in claim 9 wherein the formations of the outer arms are a row of holes and the formations of each fitting include at least one stud engageable in one of the respective outer-arm holes and another hole alignable with another of the respective outer-arm holes, the assembly further comprising bolts engaged through other holes and securing the outer arms to the fittings.

11. The furniture-actuating assembly defined in claim 10 wherein the bolts are provided with respective nuts.

12. The furniture-actuating assembly defined in claim 1 wherein the frame is formed at the axis with a pair of holes in which the pivot pins are set.

13. The furniture-actuating assembly defined in claim 12 further comprising a respective bushing on each pin between the respective outer arm and the frame.

* * * * *